US005924662A

United States Patent [19]

Monty

[11] Patent Number: 5,924,662

[45] Date of Patent: Jul. 20, 1999

[54] PORTABLE POOL CUE HOLDER FORMED OF HOOK AND LOOP FASTENER STRIPS JOINED IN INTERLOCKING FASHION

[75] Inventor: Charles Monty, Milwaukee, Wis.

[73] Assignee: Monty Corp., Milwaukee, Wis.

[21] Appl. No.: 08/669,092

[22] Filed: Jun. 24, 1996

[51] Int. Cl.[6] ..... A44B 1/18

[52] U.S. Cl. ..... 248/205.2; 211/68

[58] Field of Search ..... 248/205.2, 205.1, 248/300, 903; 211/62, 63, 65, 68

[56] References Cited

U.S. PATENT DOCUMENTS

| | | | |
|---|---|---|---|
| 4,079,839 | 3/1978 | Winfree, Jr. | 211/68 |
| 4,100,924 | 7/1978 | Rosenberg | 128/510 |
| 4,759,963 | 7/1988 | Uso, Jr. et al. | 248/205.2 |
| 4,947,997 | 8/1990 | Dinger | 211/68 |
| 5,104,076 | 4/1992 | Goodall, Jr. | 248/205.2 |
| 5,125,516 | 6/1992 | McKenna | 248/205.2 |
| 5,242,063 | 9/1993 | Ericksen et al. | 211/87 |
| 5,468,036 | 11/1995 | Brown | 294/147 |
| 5,535,928 | 7/1996 | Herring | 224/250 |

*Primary Examiner*—Ramon O. Ramirez
*Assistant Examiner*—Anita M. King
*Attorney, Agent, or Firm*—Nilles & Nilles, S.C.

[57] ABSTRACT

A holder which is especially adapted for use with pool cues comprises first, second, third and fourth fastener strips made of hook and loop (e.g., Velcro® brand) fastener strips joined in interlocking fashion. Each strip has an adhesive side and a fastener side, and the strips are attached to each other in interlocking fashion using the adhesive side of each strip. Accordingly, the holder is in a T-shaped configuration, and the first and second fastener strips are disposed generally parallel to each other and are generally perpendicular to both the third and fourth fastener strips. Additionally, parallel strips have opposite type fasteners (i.e., one strip has hook-type fasteners and the other has loop-type fasteners). In operation, a fifth fastener strip is adhesively attached to a stable surface. One of the fastener strips of the holder is then attached to the fifth fastener strip. Two remaining strips of the holder are then wrapped around the pool cue, such that opposite ends of the two strips may be fastened to each other. Accordingly, the pool cue is surrounded in two dimensions and is firmly held to the stable surface. Advantageously, the pool cue holder securely holds the pool cue to a stable surface, does not require modification of the pool cue, and is of simple construction and thus may be inexpensively produced. The pool cue holder also provides a location for attachment to a pool cue carrying case.

4 Claims, 7 Drawing Sheets

PORTABLE POOL CUE HOLDER FORMED OF HOOK AND LOOP FASTENER STRIPS JOINED IN INTERLOCKING FASHION

FIELD OF THE INVENTION

This invention relates to pool cue holders, and more particularly relates to portable pool cue holders formed of hook and loop fastener strips joined in interlocking fashion.

BACKGROUND OF THE INVENTION

Pool is a popular past time involving a six pocket billiard table and a plurality of hard balls including a cue ball. Although there are many variations, all pool games generally involve hitting the cue ball with a pool cue so as to cause one of the remaining balls to drop into one of the pockets of the billiard table.

Pool is played in pool halls, taverns, recreation centers and other facilities which are open to the public. Generally, when playing in pool halls and these other places, more avid pool players bring their own pool cues. This is especially true of players who play in pool leagues and enter highly competitive pool competitions and tournaments for prize money, but is also true of players who are beginners wishing to play with proper equipment. The pool cues used by these players can cost as much as fifteen hundred dollars and even more.

While waiting for the other player to complete his turn, a pool player will often rest his pool cue up against a bar, a bar stool, a table, or any other convenient stable surface often allowing the cue to fall. Also, other players and/or patrons may inadvertently bump the pool cue and cause it to tip and hit the floor. Such action can scratch, nick, or otherwise damage the pool cue. Clearly this is undesirable since, as noted above, pool cues can be quite expensive.

Although permanently affixed pool cue holders are known, these pool cue holders are usually filled with house cues. Further, even if not filled with house cues, these holders are usually undesirable to use because they are inconveniently placed away from where the player is sitting and are open to constant approach by other people. Thus, the pool players do not use the permanent pool cue holders and the above-described problems are not avoided.

Until now, previous attempts at supplying portable pool cue holders have been unsuccessful. Generally, the such attempts have suffered from one or more of the following drawbacks: (1) the holder is ineffective because it is unable to securely grasp the pool cue, (2) the holder is ineffective because it is can not be securely attached to a stable surface, (3) the holder is intrusive in that it requires modification of the pool cue, (4) the holder is unacceptably costly and thus is not practical for owners of more modestly priced pool cues, (5) the holder is not compact to transport or set up, (6) the holder is not convenient to put cues in repeatedly, and/or (7) the holder must be inconveniently placed away from the player, increasing the likelihood of theft of the pool cue.

Another problem is arises with respect to pool cue carrying cases which are used to transport pool cues. These cases, like the pool cues they carry, can be of high quality and be made of expensive materials such as leather. However, there is typically no place to rest the carrying cases while a pool game is in progress. Thus, the player is forced to put the carrying case on the floor of the bar, for example, where the carrying case may be trampled on or have drinks spilled thereon. If instead the carrying case is placed "out of the way," then the fact that the carrying case is out of sight increases the likelihood that it will get stolen or even misplaced accidentally and taken by another player or person trying to pick up after pool leagues, etc.

Thus, what is needed is a portable pool cue holder which overcomes the above-described problems. The portable pool cue holder also provides a location for attachment to a pool cue carrying case and uses an adapter strap provided for ease.

BRIEF SUMMARY OF THE INVENTION

A holder which is especially adapted for use with pool cues is presented. The pool cue holder comprises first, second, third and fourth fastener strips made of hook and loop (e.g., VELCRO® brand) fastener strips joined in interlocking fashion. Each strip has an adhesive side and a fastener side, and the strips are attached to each other in interlocking fashion using the adhesive side of each strip. Accordingly, the holder is in a T-shaped configuration, and the first and second fastener strips are disposed generally parallel to each other and are generally perpendicular to both the third and fourth fastener strips. Additionally, parallel strips have opposite type fasteners (i.e., one strip has hook-type fasteners and the other has loop-type fasteners).

In operation, a fifth fastener strip is adhesively attached to a stable surface. One of the fastener strips of the holder is then attached to the fifth fastener strip. Two remaining strips of the holder are then wrapped around the pool cue, such that opposite ends of the two strips may be fastened to each other. Accordingly, the pool cue is surrounded in two dimensions and is firmly held to the stable surface.

Advantageously, the pool cue holder according to the present invention is portable, and may be used by pool players (or anyone else who wishes to provide a storage place for pool cues) in pool halls, bars, recreation rooms, or wherever pool is played. Also, because the fastener strips of the holder are wrapped around the pool cue, the pool cue is securely held. Additionally, the fastener strips can be easily sized such that the holder is securely attached to the stable surface. Moreover, modifications to the pool cue are unnecessary, since there is no need to attach anything to the pool cue. Further, the pool cue holder is of simple construction, and thus may be inexpensively manufactured at prices acceptable to owners of modestly priced pool cues. Additionally, the pool cue holder is easy to transport and set up. Further, the pool cue holder may be set up in a place which is conveniently near to the owner of the pool cue, thus inhibiting theft of the pool cue. Finally, the pool cue holder may also be used to store accessories such as pool cue carrying cases or chalk.

Other significant advantages of the invention include the fact that it has possible other uses which allow for a holder with the ability of continuous ease of containment and release without any change of held object. Also, the holder is constructed so as to be easily removable from mounting strip and reused indefinitely. The mounting strip are also reusable until they no longer bond properly, and then may be replaced with replacement strips which may be initially supplied or also available thereafter.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

Figure 1:
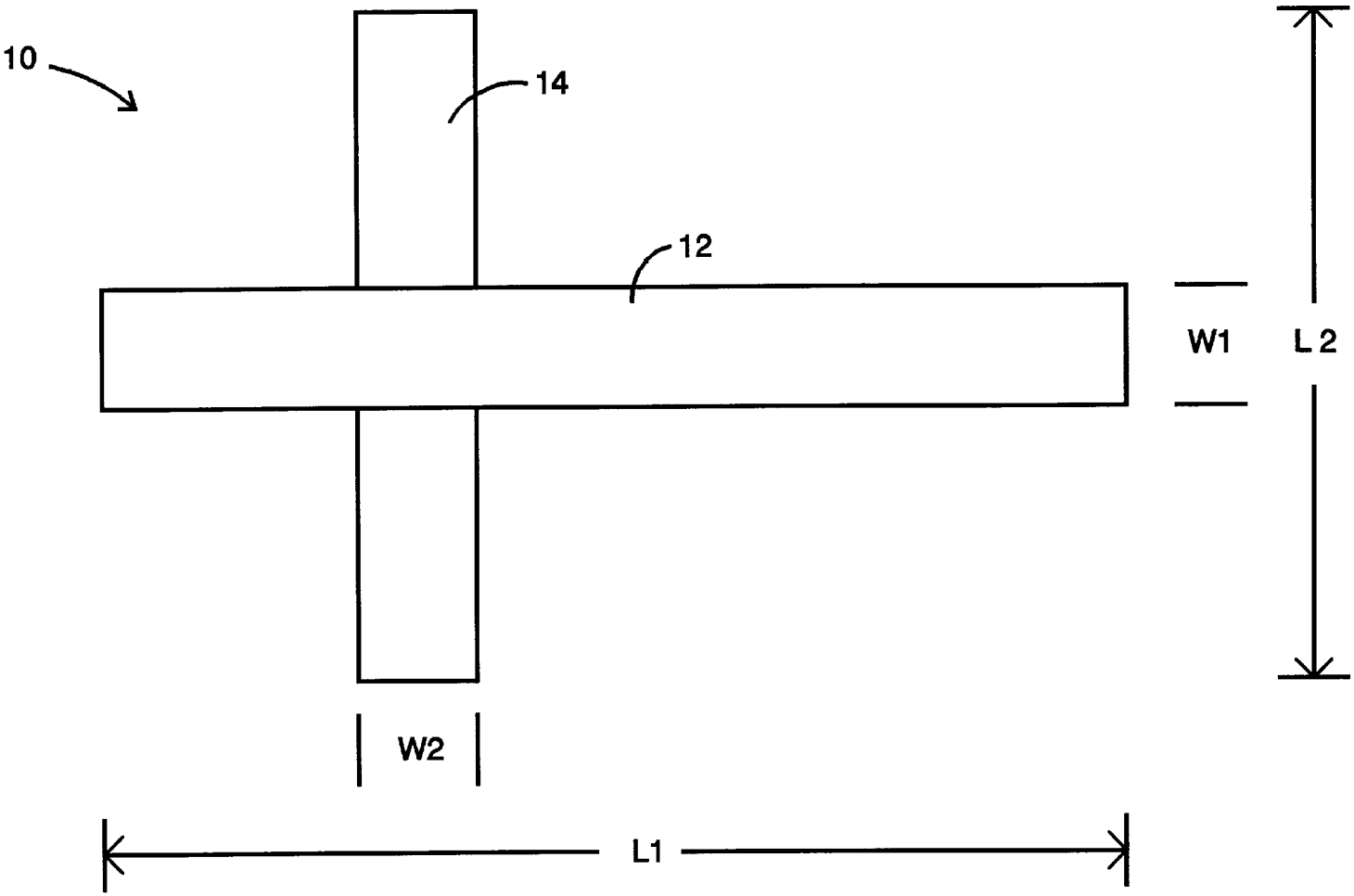
FIG. 1 is a top view of a pool cue holder in accordance with the present invention.
Figure 2A:
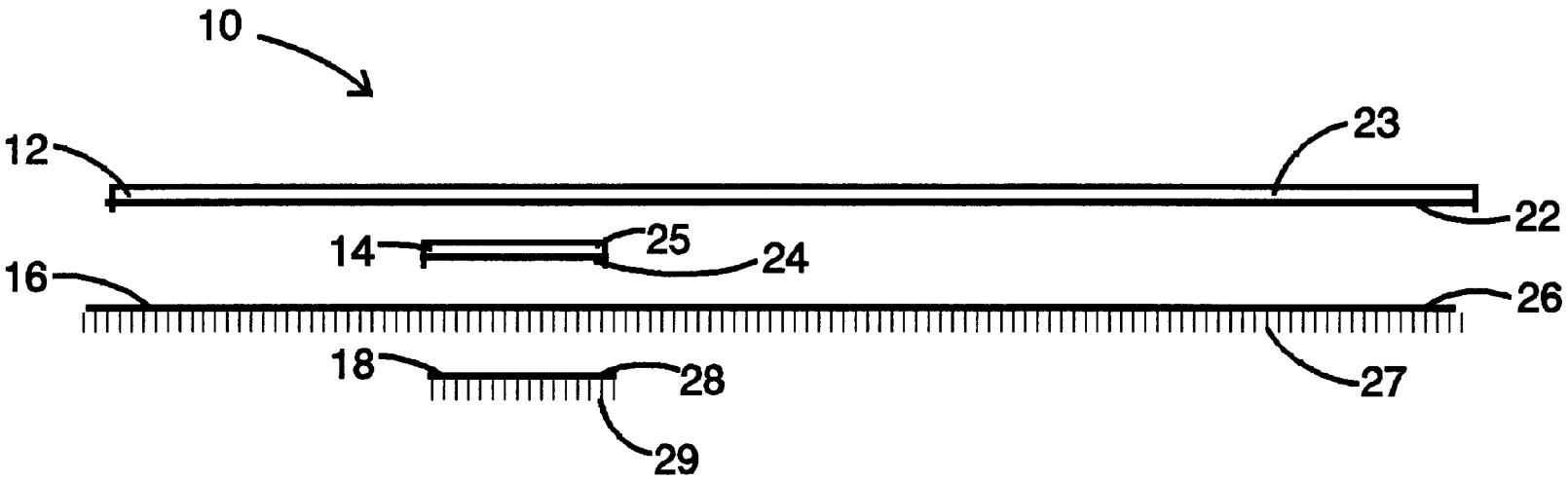
FIG. 2A is an exploded side view of a pool cue holder in accordance with the present invention, and FIG. 2B. is a side view of a plastic reinforcement which may be incorporated into the pool cue holder according to the present invention.
Figure 2B:
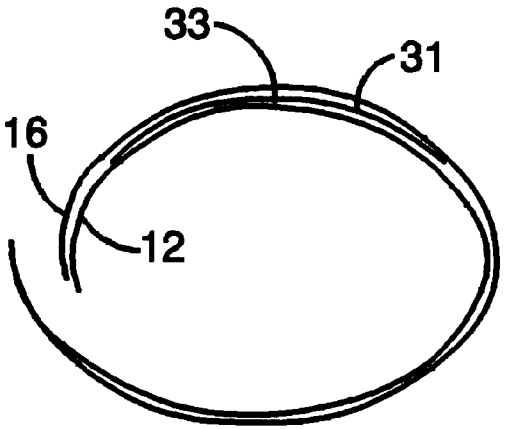
Figure 3:
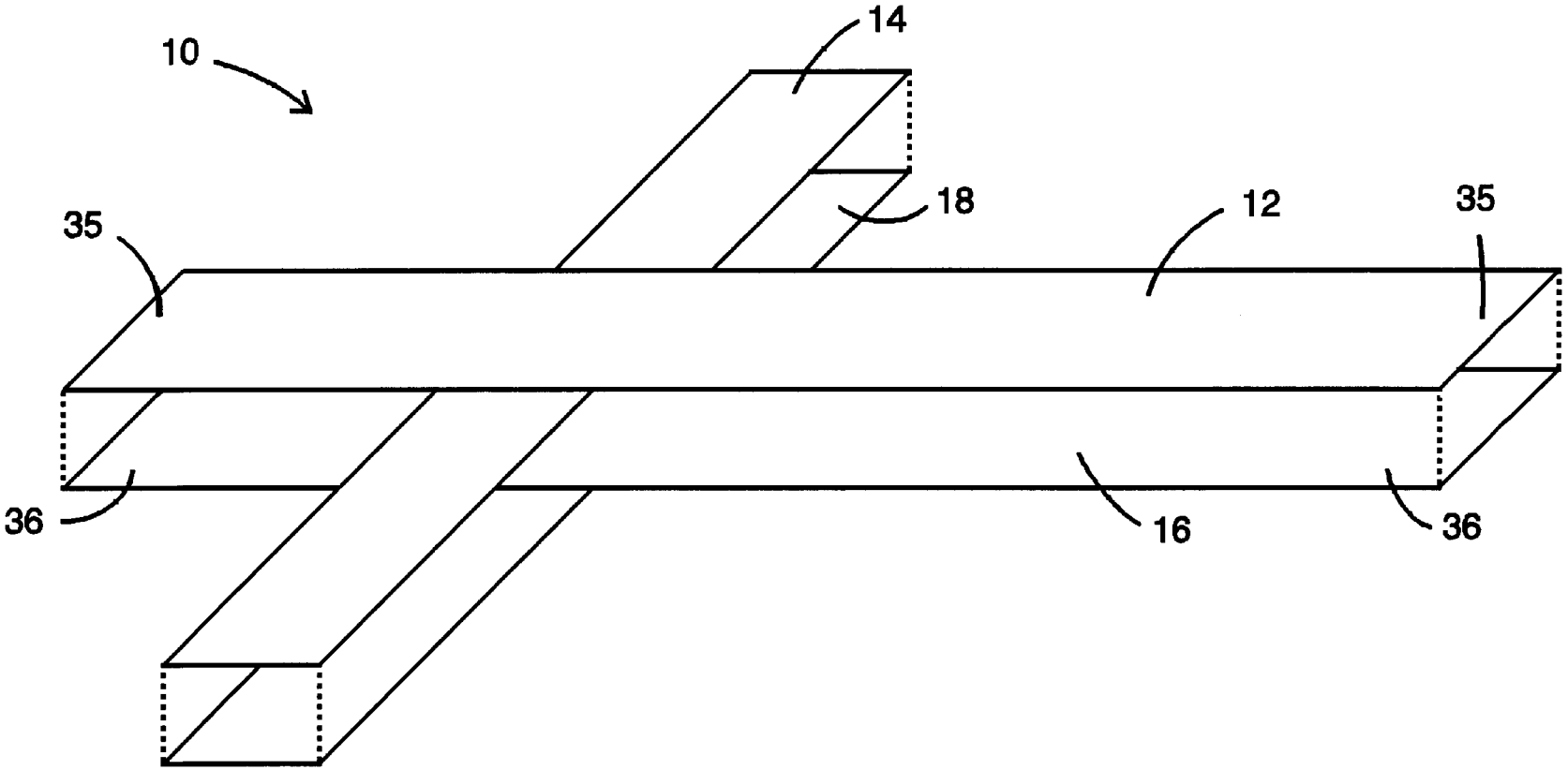
FIG. 3 is an exploded perspective view of a pool cue holder in accordance with the present invention.

Referring to FIGS. 1–3, a pool cue holder 10 according to the present invention is illustrated. The pool cue holder 10 comprises of four hook and loop (e.g., Velcro® brand) fastener strips 12–18. More specifically, the holder 10 comprises a first hook strip 12, a second hook strip 14, a first loop strip 16, and a second loop strip 18.

The widths of the strips 12–18 are preferably all the same. Thus, the width W1 of the strip 12 is the same as the width of the strip 16, the width W2 of the strip 14 is the same as the width of the strip 18, and the width W1 is the same as the width W2. The use of the same widths simplifies construction because it allows the strips to be drawn from common supply rolls. Acceptable widths vary; however, a width of about 1–3 cm is preferred, and a width of about 2 cm is most preferred.

The lengths of the strips 12 and 16 are preferably different than the lengths of the strips 14 and 18. However, the strips 12 and 16 preferably have a same length L1, and the strips 14 and 18 preferably have a same length L2. For the strips 12 and 16, a length of about 8–14 cm is preferred, and a length of about 11 cm is most preferred (assuming it is desired for the holder 10 to hold one pool cue). If it is desired for the holder 10 to hold multiple pool cues, then longer strips 12 and 16 will be required. For two pool cues, it has been found that a length in the range of 11 cm to 17 cm is preferable, and that a length of about 14 cm is most preferred. For the strips 14 and 18, a length of about 4–10 cm is preferred, and a length of about 7 cm is most preferred.

As illustrated in FIG. 2A, each of the strips 12–18 has an adhesive side and a loop or hook fastener side. Thus, the strip 12 has an adhesive side 22 and a loop fastener side 23; the strip 14 has an adhesive side 24 and a loop fastener side 25; the strip 16 has an adhesive side 26 and a hook fastener side 27; and the strip 18 has an adhesive side 28 and a hook fastener side 29. The strips 12–18 are cut from standard Velcro® fastener supply rolls, and the adhesive sides 22, 24, 26 and 28 are revealed when a protective paper backing (not illustrated) is peeled away.

The strips 12–18 are arranged such that they are joined in interlocking fashion. The parallel strips 12 and 16 are disposed on either side of the perpendicular strip 14, and the parallel strips 14 and 18 are disposed on either side of the perpendicular strip 16. Further, the strips 12–18 are arranged such that the fastener sides 23, 25, 27 and 29 are outwardly facing, while the adhesive sides 22, 24, 26 and 28 are inwardly facing. This allows the strips 12–18 to be pressed together such that a majority of the adhesive side 22 bonds to a majority the adhesive side 26 and such that a majority of the adhesive side 24 bonds to a majority of the adhesive side 28. However, where the four strips 12–18 meet, the adhesive side 22 bonds to the fastener side 25, the adhesive side 24 bonds to the adhesive side 26, and the adhesive side 28 bonds to the fastener side 27. This arrangement has been found to be quite effective for maintaining the integrity of the holder 10.

Conceivably, instead of using separate strips 12 and 16 and separate strips 14 and 18, only two strips could be used which have loops on one side and hooks on the other. These strips could, for example, be sewn together. Indeed, in final form, the strips 12 and 16 form just a single fastener strip, as do the strips 14 and 18. However, it is preferable to begin with separate strips, since hook and loop fastener material rolls with adhesive backing are more readily available.

In the preferred embodiment, a plastic reinforcement 31 (illustrated in FIG. 2B) is also incorporated into the holder 10. The reinforcement 31 has a curved shape and is preferably about one-third the length L1 of the fastener strips 12 and 16. The width of the reinforcement 31 is preferably slightly less than the width W1 of the fastener strips 12 and 16. The reinforcement 31 is placed between, and parallel with, the fastener strips 12 and 16. (Note that, for simplicity of illustration, the embodiments of FIG. 2A and FIG. 3 are illustrated without the reinforcement 31, and the strips 14 and 18 are not illustrated in FIG. 2B.) The middle portion 33 of the reinforcement 31 is placed in the region where the strips 12–18 all intersect, such that the reinforcement 31 is joined with the strips 12–18 in interlocking fashion. Advantageously, the reinforcement 31 adds rigidity and makes the holder 10 easier to use by making it easier to lock the edges 35 and 36 in place.

Figure 4:
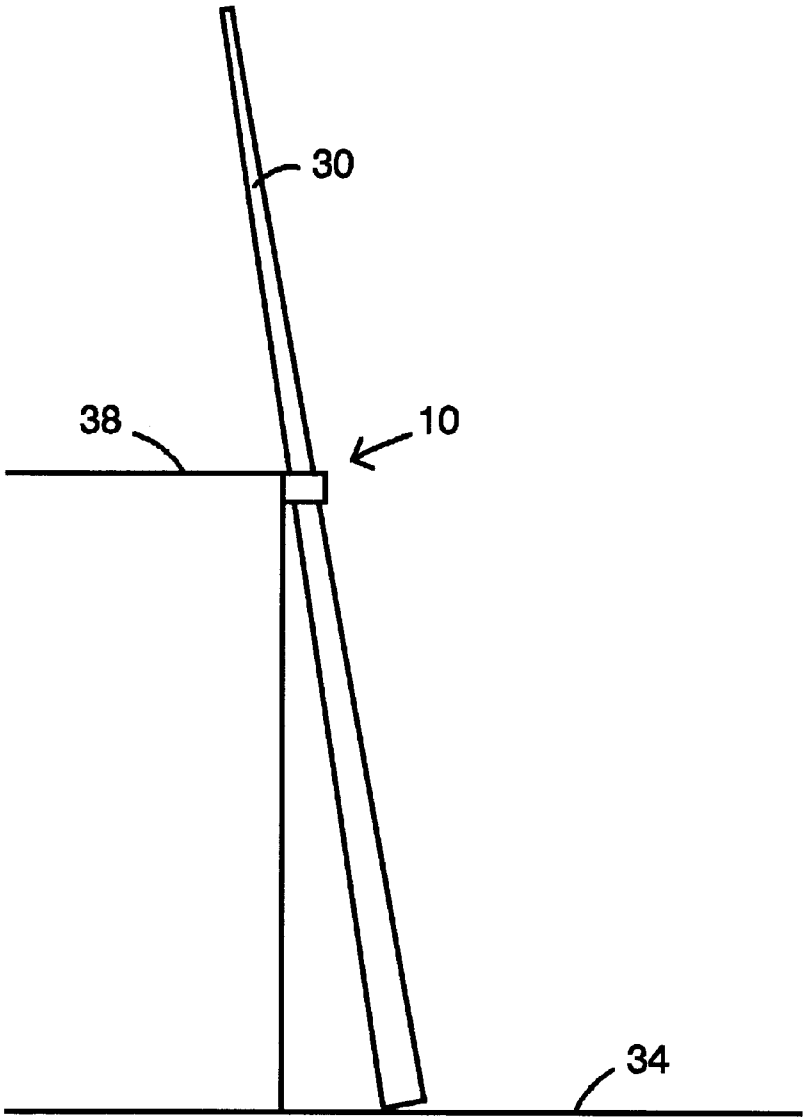
FIG. 4 illustrates the operation of a pool cue holder in accordance with the present invention.
Figure 5:
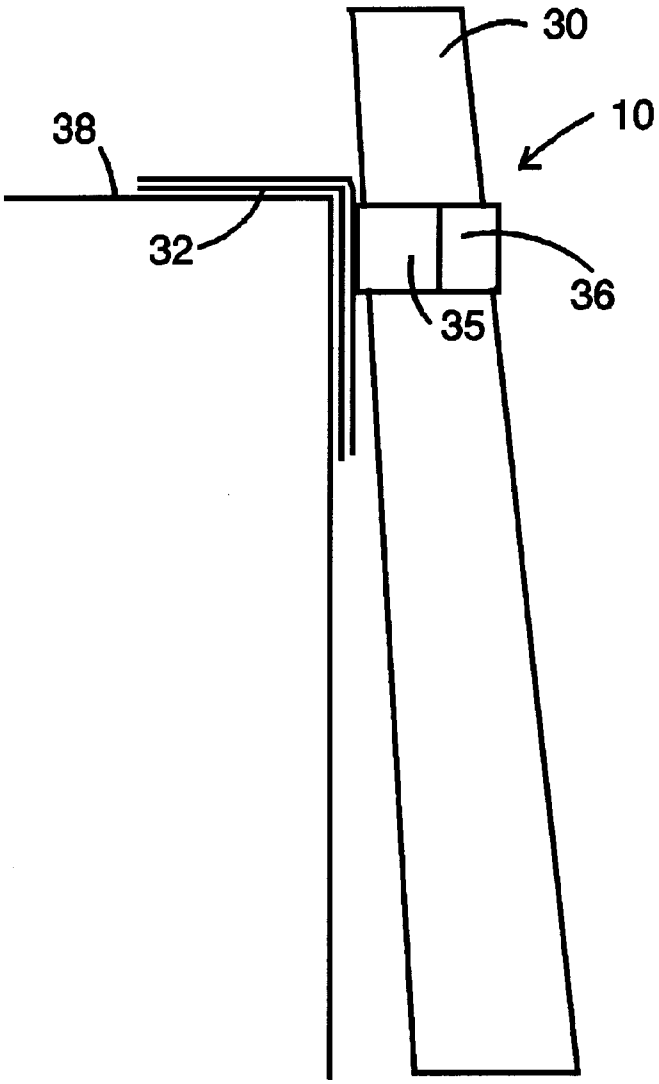
FIG. 5 is a close-up of the view illustrated in FIG. 4.

The operation of the holder 10 is illustrated in FIGS. 4–5. To use the holder 10, an additional fastener strip 32 is first attached to a stable surface 38. Like the strips 12–18, the strip 32 has an adhesive backing which is revealed when a protective paper backing is peeled way. The adhesive backing is used to attach the fastener strip 32 to the surface 38. The surface 38 may be any reasonably stable surface, such as a bar, a wall, a bar stool, a table, a bench, and so on.

It has been found that the adhesive backings of commercially available hook and loop fasteners retain their adhesiveness quite well. Thus, a same fastener strip 32 may be used for several visits to a pool hall by peeling the strip 32 from the surface 38 and replacing the paper backing. Additionally, since the strips 32 are relatively inexpensive to manufacture, it is commercially practical to sell the holder 10 with a supply of, for example, one hundred spare fastener strips 32.

Once the fastener strip 32 is adhesively mounted to the surface 38, the holder 10 may be fastened to the fastener strip 32. This may be accomplished with the loop strip 14 if the fastener strip 32 is of the hook type, or with the hook strip 18 if the fastener strip 32 is of the loop type.

Once the holder 10 is fastened to the strip 32, it may successfully be used to securely hold a pool cue 30 to the surface 38. In particular, the strips 12 and 16 are wrapped around the pool cue 30 by joining the furthest most edges 35 and 36 of the strips 12 and 16 together. The strips 12 and 16 thus encircle the pool cue 30, surround the pool cue 30 in two dimensions, and hold it securely to the surface 38. It should be apparent that, no matter how the edges 35 and 36 are joined, the loops at one edge 35 of the strip 12 will be fastened to the hooks at an opposite edge 36 of the strip 16.

If greater simplicity is desired, the strips 18 and 32 could be eliminated. In this embodiment, the adhesive backing 24 of the strip 14 would be used directly to adhere the holder 10 to the surface 38 without using the strip 32. Indeed, the strip 14 need not even be a fastener strip. Preferably, however, the fastener strips 14, 18 and 32 are utilized.

Figure 6B:
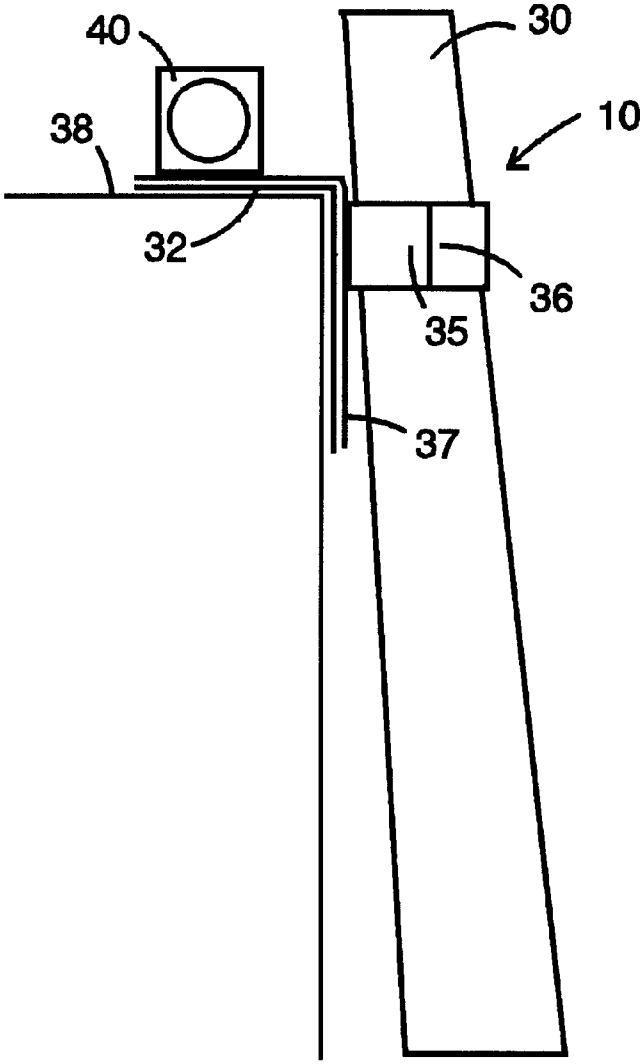
FIG. 6B illustrates an enhancement wherein the pool cue holder is also used to hold the pool cue chalk.
Figure 6A:
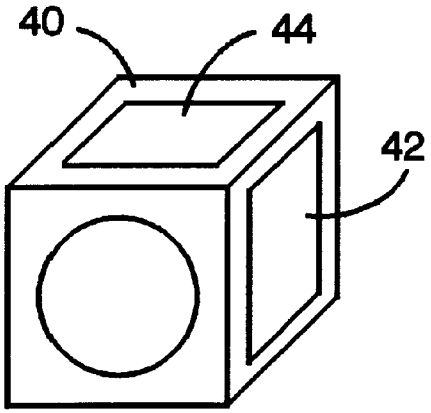
FIG. 6A illustrates pool cue chalk having hook and loop fastening squares attached thereto.

FIGS. 6A and 6B illustrate a preferred embodiment of the invention. As illustrated in FIG. 6A, according to the preferred embodiment, at least one loop fastener square 42 and at least one hook fastener square 44 is adhered to a piece of chalk 40. This can be accomplished using adhesive backings disposed on the backs of the squares 42 and 44. As illustrated in FIG. 6B, the chalk 40 may then be conveniently fastened to the holder 10. Of course, the strip 32 could also be used to hold a variety of other accessories, such as a tip shaper which similarly has a fastener adhesively attached thereto.

Figure 7B:
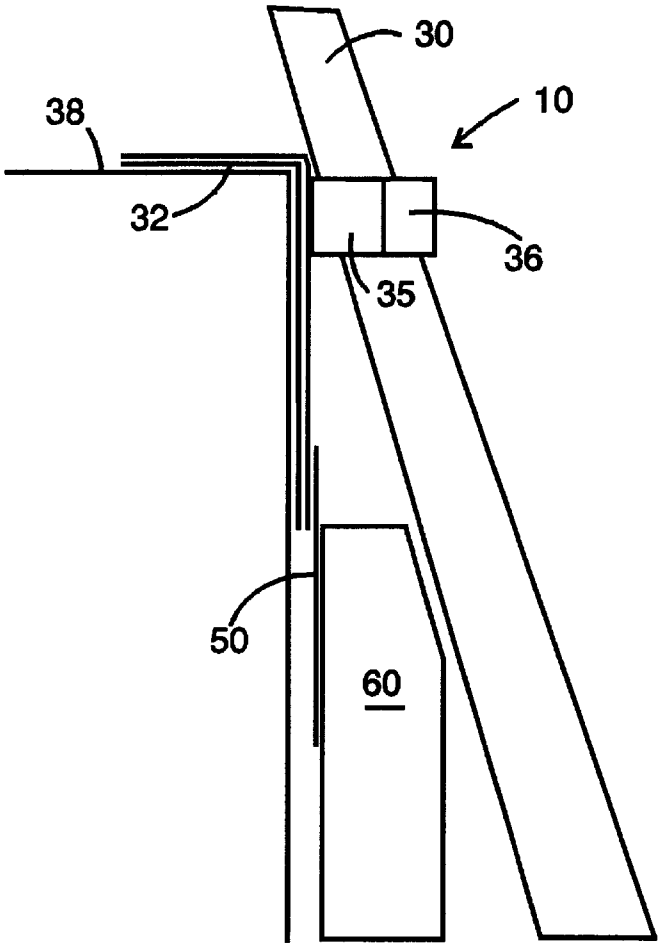
FIGS. 7A and 7B illustrates an adapter which may be used for adapting the pool cue holder according to the present invention to hold a pool cue carrying case.
Figure 7A:
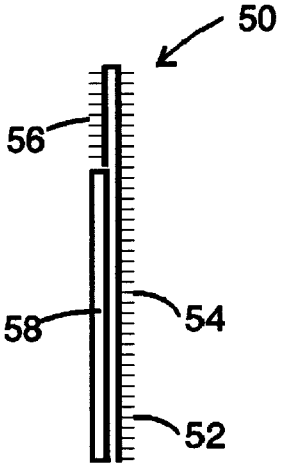

In another especially preferred embodiment illustrated in FIGS. 7A and 7B, the holder 10 also provides a location for attachment to a pool cue carrying case 60. In this embodiment, the carrying case 60 is attached to a lower region 37 of the holder 10. This could be accomplished, for example, by adhesively attaching a hook fastener strip to the carrying case, and attaching the hook fastener strip to the loop fastener strip 14. Preferably, however, it is accomplished using the adapter 50 illustrated in FIG. 7A.

The adapter 50 comprises a hook fastener strip 52 adhesively attached to a loop fastener strip 58. The hook fastener strip 52 is folded, thus forming strip sections 54 and 56. The adapter 50 is of the same width as the strips 12–18 (which may be longer in this preferred embodiment than in earlier embodiments), and has a length of about 10 cm.

In operation, the section 54 is attached to a loop fastener strip which is adhesively attached to the pool cue carrying case 60. When in use, the section 52 is attached to the lower region 37 of the holder 10. When not in use, the section 52 (along with a portion of the section 54) may be conveniently folded over and attached to the section 58. Advantageously, therefore, it is now possible to place the pool cue carrying case 60 off the floor yet still in sight. Thus, the likelihood that the pool cue carrying case 60 will get damaged or stolen is significantly reduced. Further, since pool cue cases are typically made of a padded soft material, the pool cue case forms a protective padding between the pool cue and the surface 38. Hence, the possibility of damage to the pool cue 30 is further reduced.

Many changes and modifications may be made to the present invention without departing from the spirit thereof. For example, the holder according to the present invention could be used for other purposes besides holding pool cues, such as holding fishing poles (even while fishing on bridges and in boats), holding rifles (the mounting strip could be secured onto a tree by many means such as tacks and nails where bonding of mounting strip does not adhere), and holding a bow (or bow and arrow set). Additionally, the inventive holder has a variety of uses which are not related to sporting activities. The scope of these and other changes will become apparent from the appended claims.

I claim:

1. A system for securely holding a pool cue in place, the system comprising:

(A) a stable surface; and (B) a pool cue holder, said pool cue holder including (1) a first fastener strip, said first fastener strip having a first adhesive side and a first loop fastener side;

(2) a second fastener strip, said second fastener strip having a second adhesive side and a second hook fastener side, said second fastener strip being disposed generally parallel to said first fastener strip, a majority of said second adhesive side adhering to a majority of said first adhesive side;

(3) a third fastener strip, said third fastener strip having a third adhesive side and a third loop fastener side, said third fastener strip being dispose generally perpendicular to said first fastener strip and said second fastener strip;

(4) a fourth fastener strip, said fourth fastener strip having a fourth adhesive side and a fourth hook fastener side, said fourth fastener strip being disposed generally parallel to said third fastener strip, a majority of said fourth adhesive side adhering to a majority of said third adhesive side;

(5) a plastic reinforcement, said plastic reinforcement being disposed between and generally parallel to said first and second fastener strips, and (C) a fifth fastener strip, said fifth fastener strip having a fifth adhesive side and a fifth fastener side, said fifth fastener strip being adhesively mounted to said stable surface, and said fifth fastener side being fastened to one of said third and fourth fastener strips; and (D) a plurality of additional fastener strips, each of said plurality of additional fastener strips (1) being disposable (2) being used one after the other, and (3) being adapted for replacing said fifth fastener strip when said fifth fastener strip wears out, including being adapted for being mounted to said stable surface;

wherein said first, second, third and fourth fastener strips are joined in interlocking fashion;

wherein said holder is adapted for fastening one end of said first fastener strip to an opposite end of said second fastener strip such that said first and second fastener strips are adapted for surrounding said pool cue in two dimensions;

wherein the width of said first, second, third and fourth fastener strips is in the range of about 1–3 cm;

wherein the length of said first and second fastener strips is in the range of about 8–17 cm; and wherein the length of said third and fourth fastener strips is in the range of about 4–10 cm.

2. The system according to claim 1, further comprising a fastener square, said fastener square being adapted for being adhesively mounted to a chalk cube, and said fastener square being fastened to one of said first, second, third, fourth and fifth fastener strips.

3. The system according to claim 1, wherein said stable surface is a surface of a bar stool.

4. A system for securely holding a pool cue in place, the system comprising:

(A) a stable surface; and (B) a pool cue holder, said pool cue holder including (1) a first fastener strip, said first fastener strip having a first adhesive side and a first loop fastener side;

(2) a second fastener strip, said second fastener strip having a second adhesive side and a second hook fastener side, said second fastener strip being disposed generally parallel to said first fastener strip, a majority of said second adhesive side adhering to a majority of said first adhesive side;

(3) a third fastener strip, said third fastener strip having a third adhesive side and a third loop fastener side, said third fastener strip being disposed generally perpendicular to said first fastener strip and said second fastener strip;

(4) a fourth fastener strip, said fourth fastener strip having a fourth adhesive side and a fourth hook fastener side, said fourth fastener strip being disposed generally parallel to said third fastener strip, a majority of said fourth adhesive side adhering to a majority of said third adhesive side;

(5) a plastic reinforcement, said plastic reinforcement being disposed between and generally parallel to said first and second fastener strips, and (C) a fifth fastener strip, said fifth fastener strip having a fifth adhesive side and a fifth fastener side, said fifth fastener strip being adhesively mounted to said stable surface, and said fifth fastener side being fastened to one of said third and fourth fastener strips;

(D) a plurality of additional fastener strips, each of said plurality of additional fastener strips (1) being disposable, (2) being used one after the other, and (3) being adapted for replacing said fifth fastener strip when said fifth fastener strip wears out, including being adapted for being mounted to said stable surface; and (E) an adapter, said adapter comprising sixth and seventh fastener strips of unequal length, said sixth and seventh fastener strips being disposed generally parallel to each other and being adhesively attached to each other, said sixth fastener strip being folder over and being partially adhesively attached to itself, and said adapter defining means for fastening a pool cue carrying case to said holder;

wherein said first, second, third and fourth fastener strips are joined in interlocking fashion;

wherein said holder is adapted for fastening one end of said first fastener strip to an opposite end of said second fastener strip such that said first and second fastener strips are adapted for surrounding said pool cue in two dimensions;

wherein the width of said first, second, third and fourth fastener strips is in the range of about 1–3 cm;

wherein the length of said first and second fastener strips is in the range of about 8–17 cm; and wherein the length of said third and fourth fastener strips is in the range of about 4–10 cm.

* * * * *